US012760543B1

(12) United States Patent
Glasberg

(10) Patent No.: US 12,760,543 B1
(45) Date of Patent: Oct. 13, 2026

(54) INFLATABLE POOL COVER SYSTEM, AND METHODS OF OPERATION THEREOF

(71) Applicant: Jeffrey Scott Glasberg, Pennington, NJ (US)

(72) Inventor: Jeffrey Scott Glasberg, Pennington, NJ (US)

( * ) Notice: Subject to any disclaimer, the term of this patent is extended or adjusted under 35 U.S.C. 154(b) by 233 days.

(21) Appl. No.: 18/829,793

(22) Filed: Sep. 10, 2024

Related U.S. Application Data

(60) Provisional application No. 63/638,988, filed on Apr. 26, 2024.

(51) Int. Cl.
*E04H 4/10* (2006.01)

(52) U.S. Cl.
CPC ..... *E04H 4/103* (2013.01)

(58) Field of Classification Search
CPC ..... E04H 4/1272; E04H 4/14; E04H 4/0025; A47L 9/242; A47K 3/06; A01M 1/04; A01M 1/103
See application file for complete search history.

(56) References Cited

U.S. PATENT DOCUMENTS

| | | | | |
|---|---|---|---|---|
| 4,122,561 | A | 10/1978 | Barr | |
| 4,601,072 | A | 7/1986 | Aine | |
| 4,825,479 | A | 5/1989 | Bonneau | |
| 5,293,652 | A | 3/1994 | Furr | |
| 5,373,590 | A * | 12/1994 | Svae | E04H 4/105 4/503 |
| 6,539,559 | B1 | 4/2003 | Creech et al. | |
| 8,069,504 | B1 | 12/2011 | Greenfield, Jr. | |
| 8,201,285 | B1 | 6/2012 | Pugliese et al. | |
| 10,501,952 | B1 | 12/2019 | Greenwood | |
| 10,619,369 | B1 | 4/2020 | Herd | |
| 11,814,866 | B2 | 11/2023 | Hockenberry | |
| 11,821,232 | B2 | 11/2023 | Bolen, Jr. | |
| 2007/0143915 | A1 | 6/2007 | Vangelisti | |
| 2007/0245478 | A1 | 10/2007 | Painter | |
| 2010/0083436 | A1 | 4/2010 | Wiegand | |
| 2012/0246818 | A1 | 10/2012 | Dautrich | |
| 2015/0068652 | A1 * | 3/2015 | Burris | E04H 4/103 150/154 |

(Continued)

FOREIGN PATENT DOCUMENTS

| | | | |
|---|---|---|---|
| CA | 2509313 | A1 | 12/2006 |
| GB | 2379163 | A | 3/2003 |

*Primary Examiner* — David P Angwin
*Assistant Examiner* — Bryant Khiem Huynh
(74) *Attorney, Agent, or Firm* — John Rizvi; John Rizvi, P.A.—The Patent Professor®

(57) ABSTRACT

A pool cover system includes an inflatable cover assembly which may be deployed over and fully cover a top opening of a pool with a bottom panel of the cover assembly facing the pool cavity. A cover hose may be arranged within the pool cavity and connect to an air inlet at the bottom panel of the cover assembly and to an access point opening at the sidewall of the pool from the inner side of the access point opening. An air supply hose may be arranged outside the pool and connected to a pressurized air source and to the access point opening from the outer side of the access point opening. Fluid communication is established from the pressurized air source to the air inlet of the cover assembly through the air supply hose and the cover hose, allowing to inflate the cover from outside the pool.

20 Claims, 9 Drawing Sheets

(56) References Cited

U.S. PATENT DOCUMENTS

| | | | | |
|---|---|---|---|---|
| 2015/0284970 | A1 | 10/2015 | Herd et al. | |
| 2018/0313102 | A1* | 11/2018 | Jackson, Jr. | E04H 4/103 |
| 2022/0049513 | A1 | 2/2022 | Becoflex | |
| 2023/0146987 | A1 | 5/2023 | Anacleto | |

* cited by examiner

INFLATABLE POOL COVER SYSTEM, AND METHODS OF OPERATION THEREOF

CROSS-REFERENCE TO RELATED APPLICATION

This application claims the benefit of U.S. Provisional Patent Application No. 63/638,988, filed on Apr. 26, 2024, which is incorporated by reference herein in its entirety.

FIELD OF THE INVENTION

The present invention relates generally to swimming pool covers, and more particularly, to an inflatable pool cover system which allows to inflate the cover from outside the pool, using an air supply access point which may be provided at a pool sidewall, such as at an existing pool return opening or an existing pool skimmer.

BACKGROUND OF THE INVENTION

Swimming pools have long been symbols of leisure and relaxation, transforming ordinary backyards or other outdoor or indoor environments into personal oases for recreation and social gatherings. Swimming pools may also be installed in businesses or organizational settings such as hotels, resorts, cruise ships, sports facilities, etc. for various uses. Whether above-ground or in-ground, swimming pools offer a refreshing escape during warm weather, allow to practice swimming, water gym, diving, or other in-water exercising routines, and serve as focal points for outdoor decoration and social gathering areas.

Swimming pools come in various shapes, sizes, and construction types, catering to different technical requirements, personal preferences, budgets, and spatial constraints. Among the most common distinctions are in-ground pools and above-ground pools.

In-ground pools are permanent fixtures that are integrated into the landscape or ground of a property, either indoors or outdoors. They are typically constructed by excavating the ground and installing a frame, often made of concrete, fiberglass, or vinyl, which is then lined with a waterproof coating. In-ground pools offer greater design flexibility and aesthetic appeal, allowing for customization in shape, depth, and surrounding landscaping, architectural, or decorative features. While they require more extensive construction and investment compared to above-ground pools, they often add significant value to the property and provide a luxurious outdoor or indoor amenity for homeowners and their guests, business owners, hotel or other business guests or clients, etc.

Above-ground pools are popular choices for homeowners seeking cost-effective and relatively easy-to-install aquatic solutions. Constructed with durable materials such as steel, resin, wood, aluminum, or the like, these pools are typically prefabricated and assembled on-site. Their versatility allows for customization in terms of size, shape, and depth, making them suitable for various landscapes and user preferences. Above-ground pools offer the advantage of portability, making them ideal for temporary installations which intend to provide a pool without permanent alterations to the property.

Regardless of their type, swimming pools require regular maintenance and care to ensure optimal functionality and longevity. One crucial aspect of pool maintenance is the use of pool covers, especially during periods of inactivity or inclement weather. During the winter months or extended periods of non-use, covering the pool becomes essential to prevent debris accumulation, maintain water quality, and reduce heat loss. Winter pool covers, also known as safety covers, are designed to withstand harsh weather conditions, including snow, ice, and strong winds. These covers are typically made of durable materials such as reinforced vinyl or polyethylene, with straps or anchors to secure them tightly over the pool surface.

While pool covers offer numerous benefits in terms of maintenance and protection, they also present certain challenges and drawbacks that homeowners and business owners should consider. For example, installing a pool cover requires careful attention to ensure a secure fit and proper functionality. Depending on the type of cover, installation may involve attaching straps, anchors, or mechanical rollers to facilitate cover deployment and removal. Proper installation is crucial to prevent debris from infiltrating the pool and to maintain the cover's integrity over time. For these reasons, properly installing a swimming pool cover may require several people and/or help of one or more professional installers.

Furthermore, despite their utility, pool covers have some inherent limitations and disadvantages. One common concern is the accumulation of standing water and debris on solid covers, which can cause above-ground or in-ground pool covers to collapse into the pool with the water and debris. This can cause pool damage, create safety hazards, and promote algae growth if not addressed promptly. That same accumulated water and debris may be dumped into the pool at pool re-opening, such as the following spring. Additionally, manual covers may require physical effort to deploy and remove, posing challenges for individuals with limited mobility or strength, such as the elderly. In some cases, improperly fitted covers or mechanical malfunctions can compromise their effectiveness, necessitating repairs or replacements.

Accordingly, there is an established need for solutions to at least one of the aforementioned problems. For example, there remains a need for cost-effective and relatively easy-to-install swimming pool covers which may be installed by a wider variety of adult individuals owning or managing a home or business swimming pool, and is effective at keeping debris, water, and ice off the cover during the winter or when the pool is not in use.

SUMMARY OF THE INVENTION

The present invention is directed to a cost-effective and convenient inflatable pool cover system which may be easily and rapidly installed, uninstalled, and maintained, and may be inflated by commercial inflation or air blowing apparatus (e.g., a commercial shop-vac with blower capability). Advantageously, the present invention allows to inflate the cover from outside the pool, using an air supply access point which may be provided at the pool sidewall; in advantageous embodiments, the air supply access point may be more specifically provided at an existing pool return opening or an existing pool skimmer.

In a first implementation of the invention, a pool cover system is configured to cover a top opening of a pool when the pool is not in use, the pool comprising a pool cavity accessible through the top opening, the pool cover system. The pool cover system may include:

- a cover assembly, inflatable from a deflated state to an inflated state through an air inlet arranged at a bottom panel of the cover assembly, the air inlet in fluid communication with an interior space of the cover assembly;

a cover hose, connectable between the air inlet of the cover assembly and an access point opening at a sidewall of the pool, from an inner side of the access point opening facing the pool cavity; and an air supply hose, connectable between a pressurized air source arranged outside the pool and the access point opening at the sidewall of the pool, from an outer side of the access point opening opposite the inner side; wherein the pool cover system is configured to adopt an inflation configuration in which the cover assembly is deployed over and fully covers the top opening of the pool with the air inlet and the bottom panel of the cover assembly facing the pool cavity, and the cover hose is arranged within the pool cavity and is connected to the air inlet of the cover assembly and to the access point opening from the inner side of the access point opening, and further in which the air supply hose is arranged outside the pool and is connected to the access point opening from the outer side of the access point opening and to a pressurized air source, and further in which fluid communication is established from the pressurized air source to the interior space of the cover assembly through the air supply hose and the cover hose, and an inflated configuration reachable from the inflation configuration by operating the pressurized air source to inject compressed air into the air supply hose and thereby inflating the cover assembly to the inflated state.

In a second aspect, the cover assembly may include a top panel arranged above the bottom panel. The interior space may be defined by and between the top and bottom panels. An outer, top side of the top panel may provide the outer, top side of the cover assembly.

In another aspect, in the inflated configuration of the pool cover system, an outer, top side of the cover assembly opposite the pool cavity may be shaped to direct water and debris falling thereon towards an outer peripheral edge of the cover assembly by gravity.

In another aspect, in the inflated configuration of the pool cover system, the bottom panel may be generally flat.

In another aspect, in the inflated configuration of the pool cover system, the outer, top side of the cover assembly may be entirely convex and dome-shaped.

In yet another aspect, in the inflated configuration of the pool cover system, the top panel of the cover assembly may be dome-shaped.

In another aspect, in both the inflation configuration and the inflated configuration of the pool cover system, the cover hose may be arranged within the pool cavity in its entirety.

In another aspect, the cover hose may be disconnectably connectable to the air inlet of the cover assembly.

In another aspect, the pool cover system may further include a hose fitting configured to disconnectably thread the cover hose to the air inlet of the cover assembly.

In yet another aspect, the cover hose may be disconnectably connectable to the access point opening.

In another aspect, the pool cover system may further include a hose fitting configured to disconnectably thread the cover hose to the access point opening.

In another aspect, the air supply hose may be disconnectably connectable to the pressurized air source.

In another aspect, the air supply hose may be disconnectably connectable to the access point opening.

In yet another aspect, the pool cover system may further include a hose fitting configured to disconnectably thread the air supply hose to the access point opening.

In another aspect, the pool cover system may further include a cap, which may be disconnectably connectable to the access point opening at the sidewall of the pool, from the outer side of the access point opening and in lieu of the air supply hose, to sealingly close the access point opening. The pool cover system may be further configured to adopt a sealed configuration, reachable from the inflated configuration by disconnecting the air supply hose from the access point opening and instead connecting the cap to the access point opening with the cover assembly in the inflated state, the cap sealingly closing the access point opening and preventing air in the inflated cover from escaping through the access point opening.

In another aspect, the access point opening may be a pool return opening.

In another aspect, the pool cover system may further include a skimmer plate sealingly attachable to a skimmer opening at the sidewall of the pool. The skimmer plate may include the access point opening. In the inflation configuration of the pool cover system, the skimmer plate may be sealingly secured to the skimmer opening and the access point opening may be positioned at the skimmer opening.

In another aspect, the skimmer plate may include one or more fastener openings configured to align with respective one or more skimmer fastener openings of the pool for the insertion of respective one or more fasteners therethrough to secure the skimmer plate over the skimmer opening.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a cost-effective and convenient inflatable pool cover system which may be easily and rapidly installed, uninstalled, and maintained, and may be inflated by commercial inflation or air blowing apparatus (e.g., a commercial shop-vac with blower capability). Advantageously, the present invention allows to inflate the cover from outside the pool, using an air supply access point which may be provided at the pool sidewall, and in advantageous embodiments, more specifically provided at an existing pool return opening or an existing pool skimmer.

Figure 1:
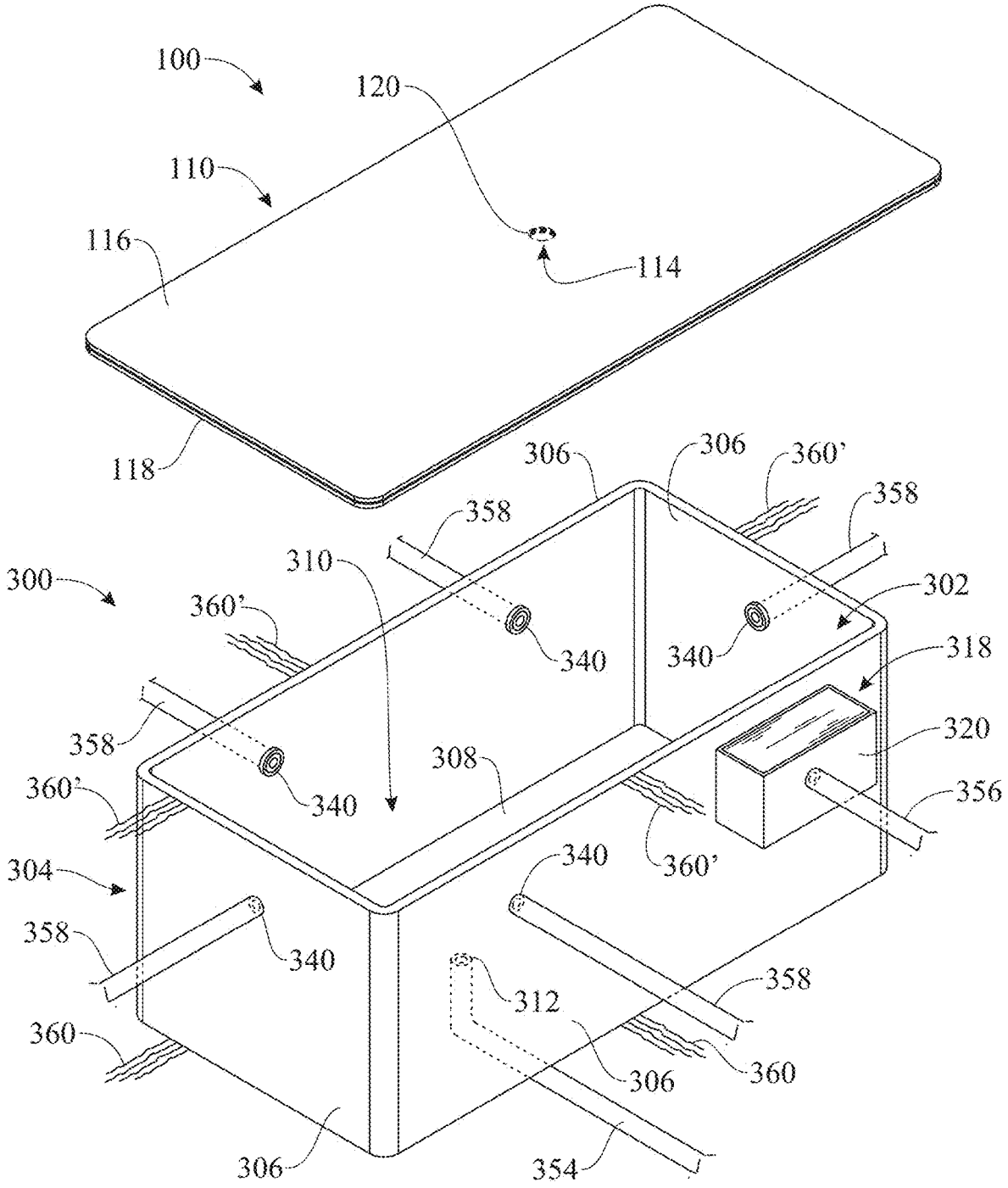
FIG. 1 presents a top isometric view of a cover assembly of a pool cover system in accordance with a first illustrative embodiment of the present invention, the cover assembly shown in exploded form with respect to an illustrative swimming pool on which the cover assembly is to be mounted.

Referring initially to FIG. 1, a pool cover system 100 is shown in accordance with a first illustrative embodiment of the present invention. The pool cover system 100 includes a cover assembly 110, configured to extend over and cover a top opening 302 of a swimming pool, hereinafter referred to as pool 300. The pool 300 may include a sidewall assembly 304, which may include one or more sidewalls 306. For example, in different embodiments or applications of the invention, the sidewall assembly may consist of: a single cylindrical sidewall; four sidewalls 306 forming a rectangular assembly (as shown); four walls forming a square assembly; six walls forming a hexagonal assembly; or other shape or wall configuration. A floor 308 may be provided below the sidewall assembly 304 and extending from the sidewalls 306. The sidewall assembly 304 and the floor 308 may define a pool cavity 310, which is configured to be filled with water (not shown). The top opening 302 is in spatial communication with the pool cavity 310 and with the water contained therein, allowing access to the pool 300 for maintenance or use.

As is known in the art, the pool 300 is typically provided with a water circulation system 318 configured to remove debris from the water and sanitize the water. The water circulation system 318 may generally include a main drain 312 at the pool floor 308, at least one water outlet or skimmer 320 and at least one water inlet or return 340. The main drain 312 and skimmer 320 constitute respective openings allowing for water and debris to exit the pool cavity 310. In turn, the return 340 provides an opening or jet 342 (FIG. 4) through which clean water is injected back into the pool cavity 310. The water circulation system 318 may further include a pump and water filtering system (not shown) and a plurality of tubings or hoses 352 enabling fluid communication between the pool cavity 310 and the pump and water filtering system. The plurality of hoses 352 may include a main drain hose 354 and a skimmer hose 356 connected to and extending from the main drawing 312 and the skimmer 320, respectively. The plurality of hoses 352 may further include return hoses 358 connected to the returns 340. Via the main drain hose 354 and the skimmer hose 356, soiled water may flow from the main drain 312 and skimmer 320, respectively, to the water filtering system. The water filtering system may filter the water, add sanitizing chemicals to the water, and pump the sanitized and filtered water to the one or more returns 340 via the respective return hoses 358. The one or more returns 340 may inject the filtered and sanitized water back into the pool cavity 310. Water circulation, filtering and sanitation may be carried out regularly during pool usage season.

In installations in which the pool 300 is an above-ground pool, the pool 300 may generally rest on the ground and the sidewall assembly 304 may extend above the ground, the ground level or ground (indicated with reference numeral 360) therefore being located generally at the base of the pool 300, as shown. Conversely, an in-ground pool 300 is typically embedded into the ground, such that the ground level or ground (indicated with reference numeral 360') is instead located generally at the top of the sidewall assembly 304. In both above-ground and in-ground installations, when the pool 300 is not in use, such as during cold winter season, water circulation is shut down and the top opening 302 is advantageously covered by the pool cover system 100 of the present invention, as hereinafter described.

Figure 2:
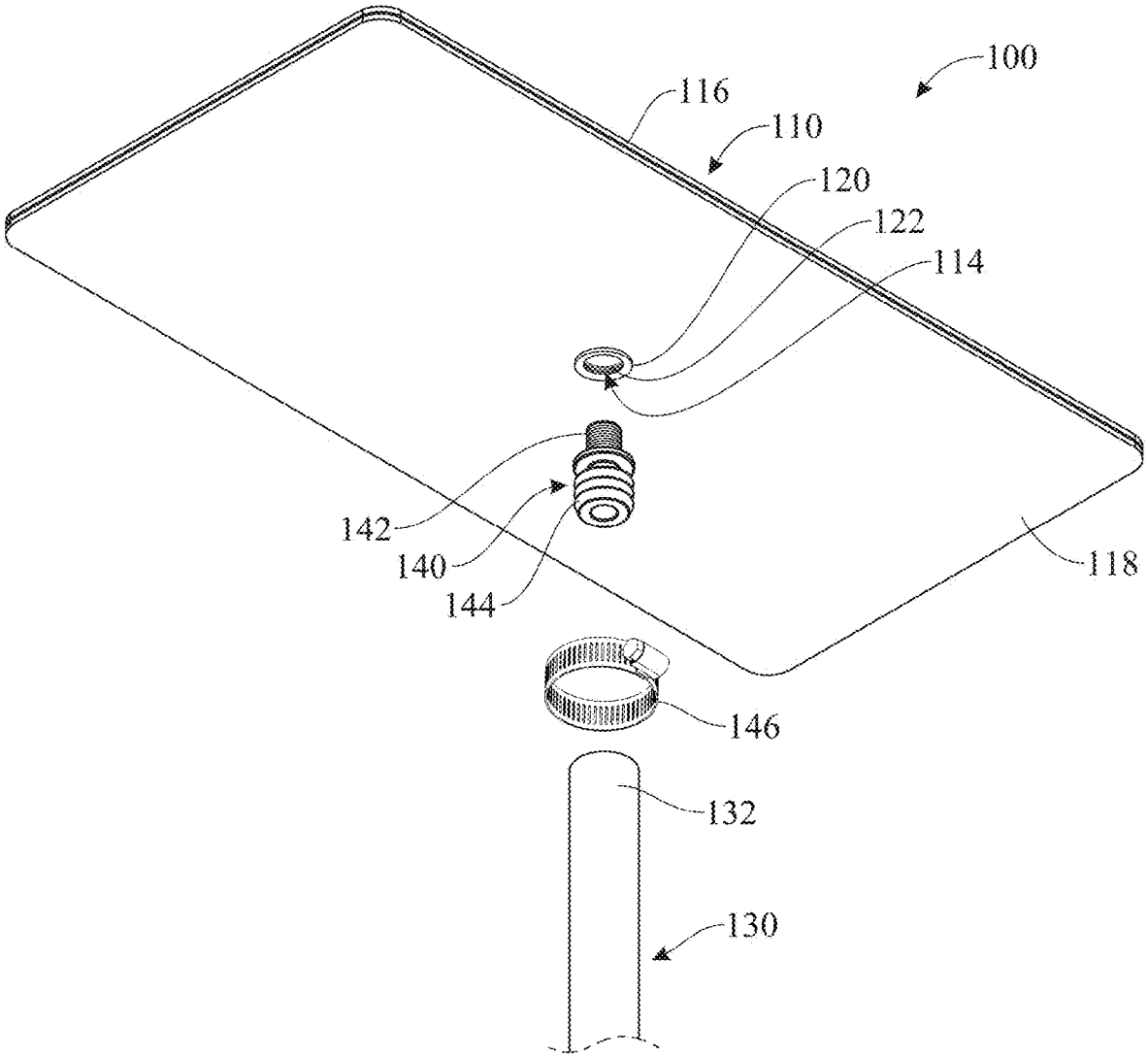
FIG. 2 presents an exploded, bottom isometric view of the cover assembly of FIG. 1, together with a first hose fitting, cover hose, and clamp of the pool cover system.

With reference now to FIGS. 1 and 2, the pool cover system 100 may include a cover assembly 110 configured to extend over and cover the top opening 302. The cover assembly 110 is formed as an inflatable structure or bladder, including one or more interior cavities or spaces 112 which may be filled with air through one or more air inlets 114 formed in the cover assembly 110 and providing access to the one or more interior spaces 112. In preferred embodiments of the invention, the one or more interior spaces 112 may specifically consist of a single interior cavity or space 112, and the one or more air inlets 114 may consist of a single air inlet 114 providing access to the single interior space 112.

The inflatable cover assembly 110 may include a plurality of panels defining the interior space 112 therebetween. For instance, the plurality of panels may comprise, and more preferably consist of, a top panel 116 and a bottom panel 118, which may be arranged facing one another and attached to one another at outer edges thereof such as to air-tightly define and enclose the interior space 112 therebetween. One or both of the top panel 116 and the bottom panel 118 are deformable to allow the cover assembly 110 to expand and compress when inflated and deflated, respectively. In preferred embodiments, both the top panel 116 and the bottom panel 118 are deformable and allow the deflated cover assembly 110 to be folded or rolled, as shown for instance in FIG. 5.

Figure 6:
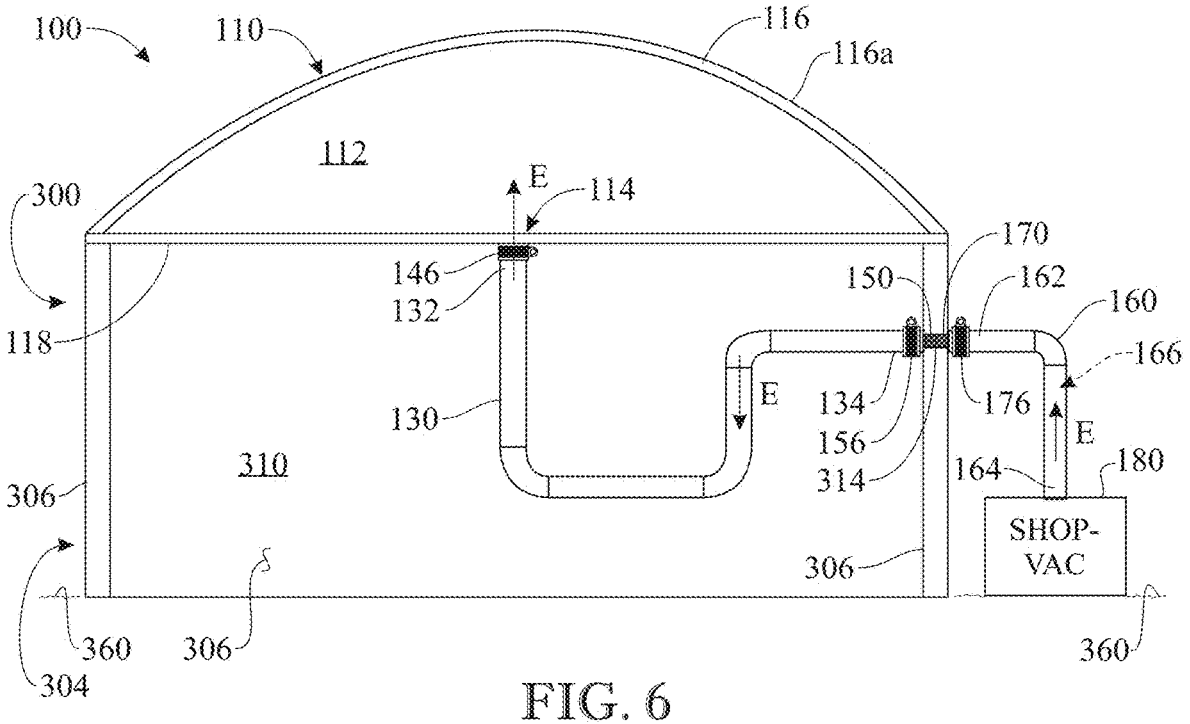
FIG. 6 presents a cross-sectional side elevation view, similar to FIG. 5, with the cover assembly shown inflated and fully deployed over the top opening of the pool, and the cover hose and air supply hose connected to one another via the threaded opening, enabling fluid communication between a pressurized air source and the cover assembly.

In preferred embodiments, such as the present embodiment, the cover assembly 110 is configured to adopt a dome-shape when inflated, as shown in FIG. 6, in which an outer, top side 116*a* of the top panel 116 is convex or dome-shaped. In such dome-shaped embodiments, the top panel 116 may be generally non-stretchable and permanently sized larger than the bottom panel 118, such that when the cover assembly 110 is deflated and the top and bottom panels 116 and 118 are arranged in a rest position (FIGS. 1, 2 and 4) the top panel 116 is generally loose (see FIG. 3) and further such that, when the cover assembly 110 is inflated, the top panel 116 deforms or deploys, and adopts the convex shape. Alternatively or additionally, the top panel 116 may be stretchable such that, when the cover assembly 110 is inflated, the top panel 116 may stretch and thereby adopt the dome shape. The bottom panel 118, in turn, may be generally non-stretchable and configured to remain in a generally flat or planar configuration when the cover assembly 110 is deflated and inflated.

Figure 3:
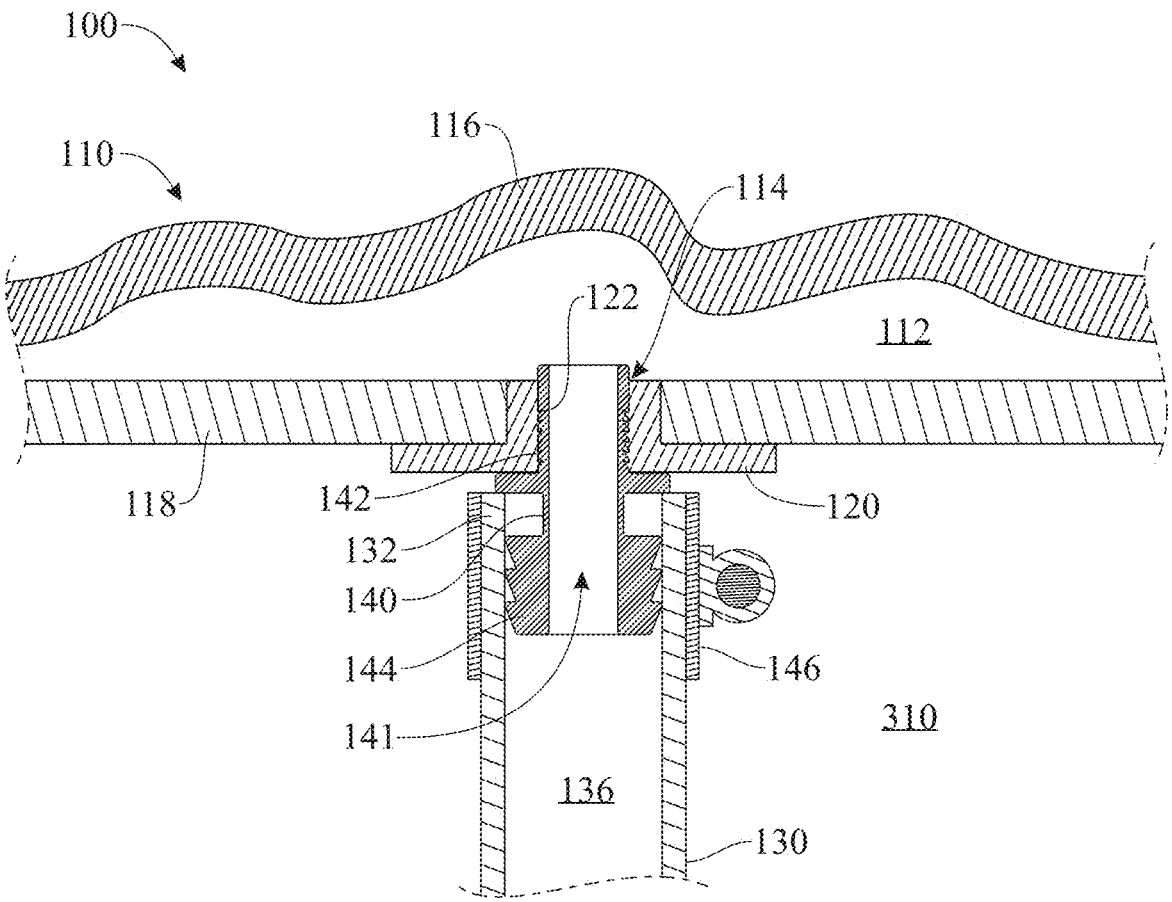
FIG. 3 presents a cross-sectional side elevation view of the cover hose and cover assembly of FIG. 2 connected to one another via the first hose fitting and the clamp.

With reference to FIGS. 2 and 3, the cover assembly 110 may include a threaded fitting 120 attached to and positioned at the bottom panel 118, the threaded fitting 120 providing the air inlet 114. The threaded fitting 120 includes a thread 122 at the air inlet 114; in some embodiments, the thread 122 may be a female thread. The threaded fitting 120 may be generally rigid or substantially more rigid than the bottom panel 118, facilitating providing a threaded connection (thread 122) to an otherwise flexible bottom panel 118 in preferred embodiments.

The pool cover system 100 may further include an air tubing or cover hose 130, comprising a first end 132 (FIG. 2), an opposite, second end 134 (FIG. 5), and an interior, through space 136 (FIG. 3) in fluid communication with the first and second ends 132 and 134. The cover hose 130 is airtightly constructed to enable efficient airflow between the first and second ends 132 and 134. In preferred embodiments, the cover hose 130 is flexible or deformable to facilitate repositioning the cover hose 130 within the pool cavity 310 during installation and removal of the pool cover system 100.

As shown in FIGS. 2 and 3, the pool cover system 100 may further include a first hose adapter or fitting 140, connectable between the threaded fitting 120 of the cover assembly 110 and the first end 132 of the cover hose 130. The first hose fitting 140 comprises a through bore 141 for the passage of air therethrough. The first hose fitting 140 may include a thread 142 and a hose connection end 144 at opposite ends thereof. As shown in FIG. 3, the thread 142 of the first hose fitting 140 may preferably disconnectably thread onto the thread 122 of the threaded fitting 120, and the hose connection end 144 may preferably disconnectably connect to the first end 132 of the cover hose 130. A clamp 146 may be fitted over the first end 132 of the cover hose 130 to sealingly (i.e., airtightly) tighten the first end 132 against the hose connection end 144 of the first hose fitting 140. When the cover hose 130 is attached to the air inlet 114 of the cover assembly 110 via the first hose fitting 140, fluid communication is established between the second end 134 of the cover hose 130 and the interior space 112 of the cover assembly 110 via the through space 316 of the cover hose 130, and the through bore 141 of the first hose fitting 140 which interconnects the first end 132 of the cover hose 130 and the air inlet 114 of the cover assembly 110, as shown for instance in FIG. 6.

Figure 5:
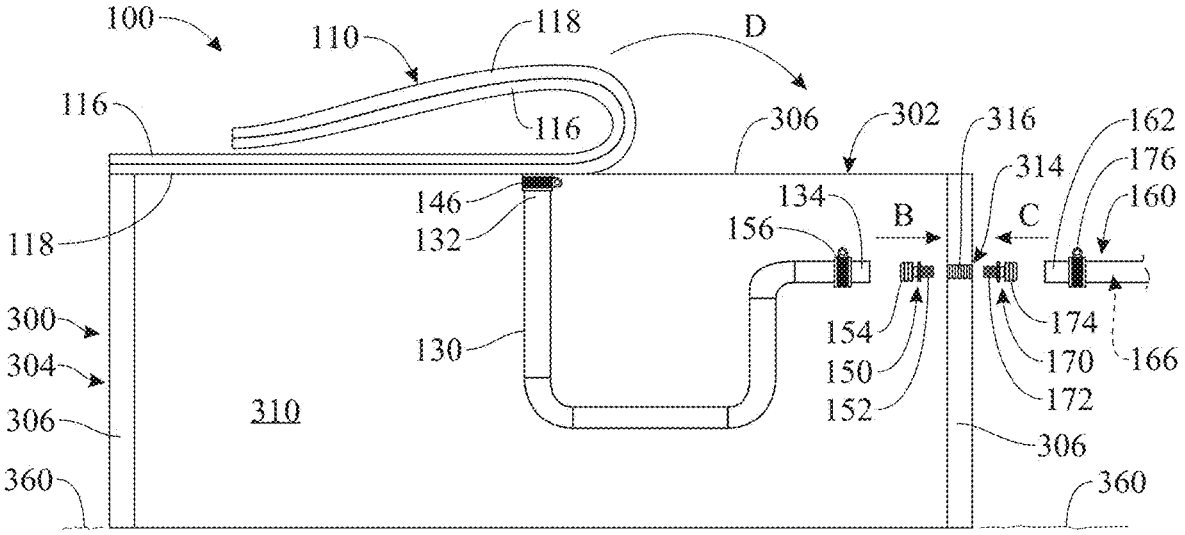
FIG. 5 presents a cross-sectional side elevation view of the pool cover system of the previous figures arranged at a pool, the cover assembly shown deflated and partially deployed over a top opening of the pool, and the cover hose and air supply hose shown disconnected from the threaded opening in the pool sidewall.

Referring now to FIG. 5, the pool cover system 100 may further include a second hose fitting 150, connectable between the second end 134 of the cover hose 130 and a threaded opening 314 of a sidewall 306 of the pool 300. In a preferred embodiment, the threaded opening 314 may be obtained or made readily available by unthreading a return 340 of the pool 300 from a pool return threaded opening provided at the sidewall 306 for the initial or default purpose of attaching the return 340 (the pool return threaded opening thereby providing or constituting the threaded opening 314). The second hose fitting 150 may be constructed similarly or the same as the first hose fitting 140. For example, as shown, the second hose fitting 150 may include a thread 152 and a hose connection end 154 at opposite ends thereof; the second hose fitting 150 may also include a through bore similar to the through bore 141 of the first hose fitting 140. The thread 152 of the second hose fitting 150 may preferably disconnectably thread onto a thread 316 of the threaded opening 314 at the sidewall 306, and the hose connection end 154 may preferably disconnectably connect to the second end 134 of the cover hose 130. A clamp 156 may be fitted over the second end 134 of the cover hose 130 to sealingly tighten the second end 134 against the hose connection end 154 of the second hose fitting 150. When the cover hose 130 is attached to the threaded opening 314 of the pool sidewall 306 via the second hose fitting 150, fluid communication is established between the through space 136 of the cover hose 130 and the threaded opening 314 via the through bore of the second hose fitting 150.

With reference to FIGS. 5 and 6, the pool cover system 100 may include an air supply hose 160 and a third hose fitting 170. The air supply hose 160 may have a first end 162, an opposite, second end 164, and a through space 166 extending from and providing fluid communication between the first and second ends 162 and 164. The air supply hose 160 is airtightly constructed to enable efficient airflow along the through space 166 between the first and second ends 162 and 164. In preferred embodiments, the air supply hose 160 is flexible or deformable to facilitate repositioning the air supply hose 160 during installation and removal of the pool cover system 100, as will be described hereinafter.

The third hose fitting 170 includes a through bore 171 and is connectable between the first end 162 of the air supply hose 160 and the threaded opening 314 of the sidewall 306 of the pool 300, from the outside of the sidewall 306, i.e.

oppositely to the second hose fitting 150. As shown, the third hose fitting 170 may include a thread 172 and a hose connection end 174 at opposite ends thereof. The thread 172 of the third hose fitting 170 may preferably disconnectably thread onto the thread 316 of the threaded opening 314, and the hose connection end 174 of the third hose fitting 170 may preferably disconnectably connect to the first end 162 of the air supply hose 160. A clamp 176 may be fitted over the first end 162 of the air supply hose 160 to sealingly tighten the first end 162 against the hose connection end 174 of the third hose fitting 170. In turn, the second end 164 of the air supply hose 170 is connectable to a compressed or pressurized air source 180, such as, but not limited to, a commercial shop-vac with air pumping capability. When the air supply hose 160 is attached to the threaded opening 314 of the pool sidewall 306 via the third hose fitting 170, fluid communication is established from the second end 164 of the air supply hose 160 (and thus the pressurized air source 180) to the threaded opening 314 via the through space 166 of the air supply hose 160 and the through bore 171 of the third hose fitting 170.

Figure 7:
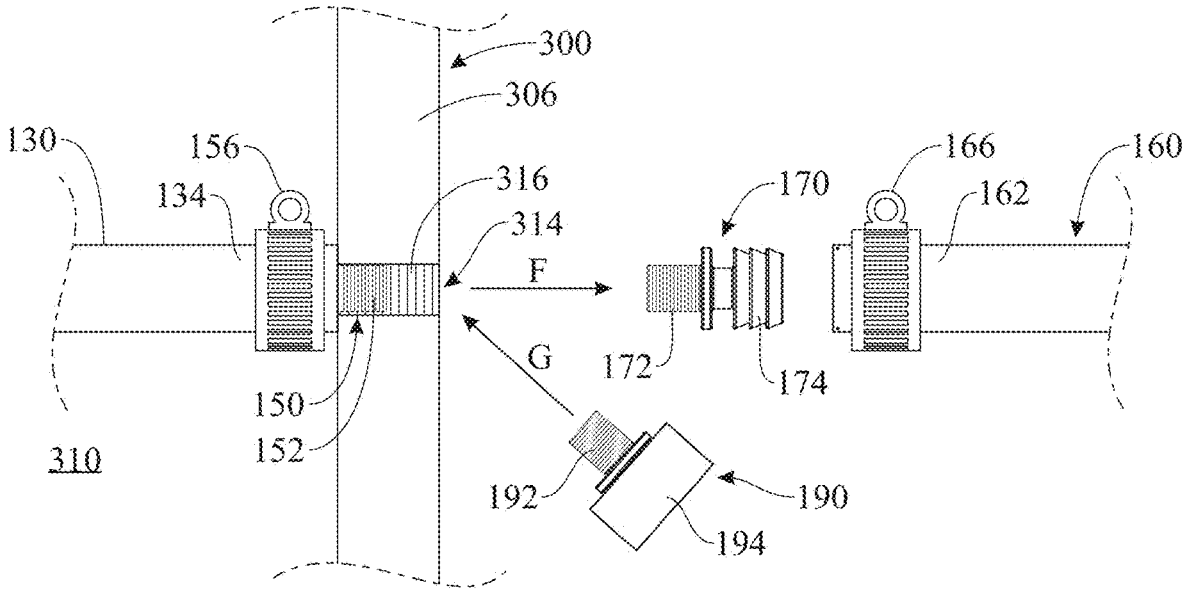
FIG. 7 presents an enlarged, cross-sectional side elevation view of the air supply hose being disconnected from the threaded opening and a threaded cap being connected to the threaded opening.
Figure 8:
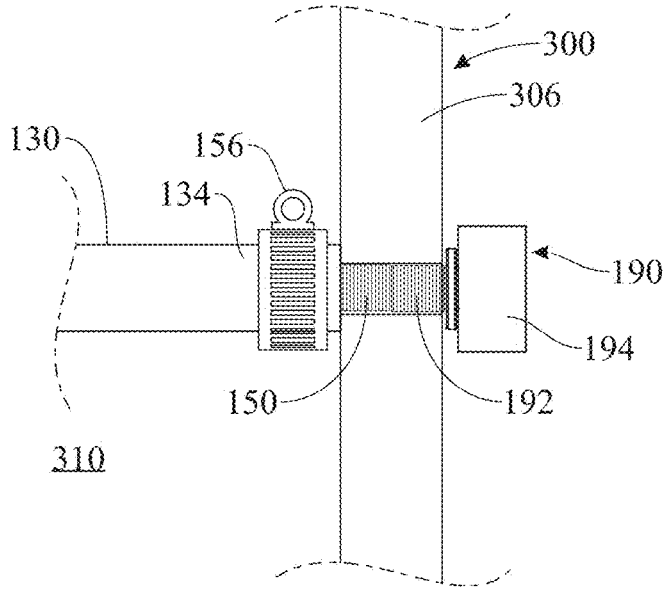
FIG. 8 presents a cross-sectional side elevation view, similar to FIG. 7, in which the cap is shown connected to and sealingly closing the threaded opening.

As shown in FIGS. 7 and 8, the pool cover system 100 may further include a cap 190. The cap 190 may disconnectably thread to the threaded opening 314 at the pool sidewall 306, on the outer side of the sidewall 306 and alternatively to the third threaded fitting 170, for purposes described hereinafter. More specifically, the cap 190 may include a thread 192 configured to thread onto and unthread from the thread 316 of the threaded opening 314. When threaded onto the threaded opening 314, the cap 190 sealingly closes the threaded opening 314, for purposes described hereinafter. A grip portion 194 may be provided on the cap 190 to facilitate a manual rotation of the cap 190 to thread and unthread of the cap 190 onto and from the threaded opening 314, respectively.

Figure 9:
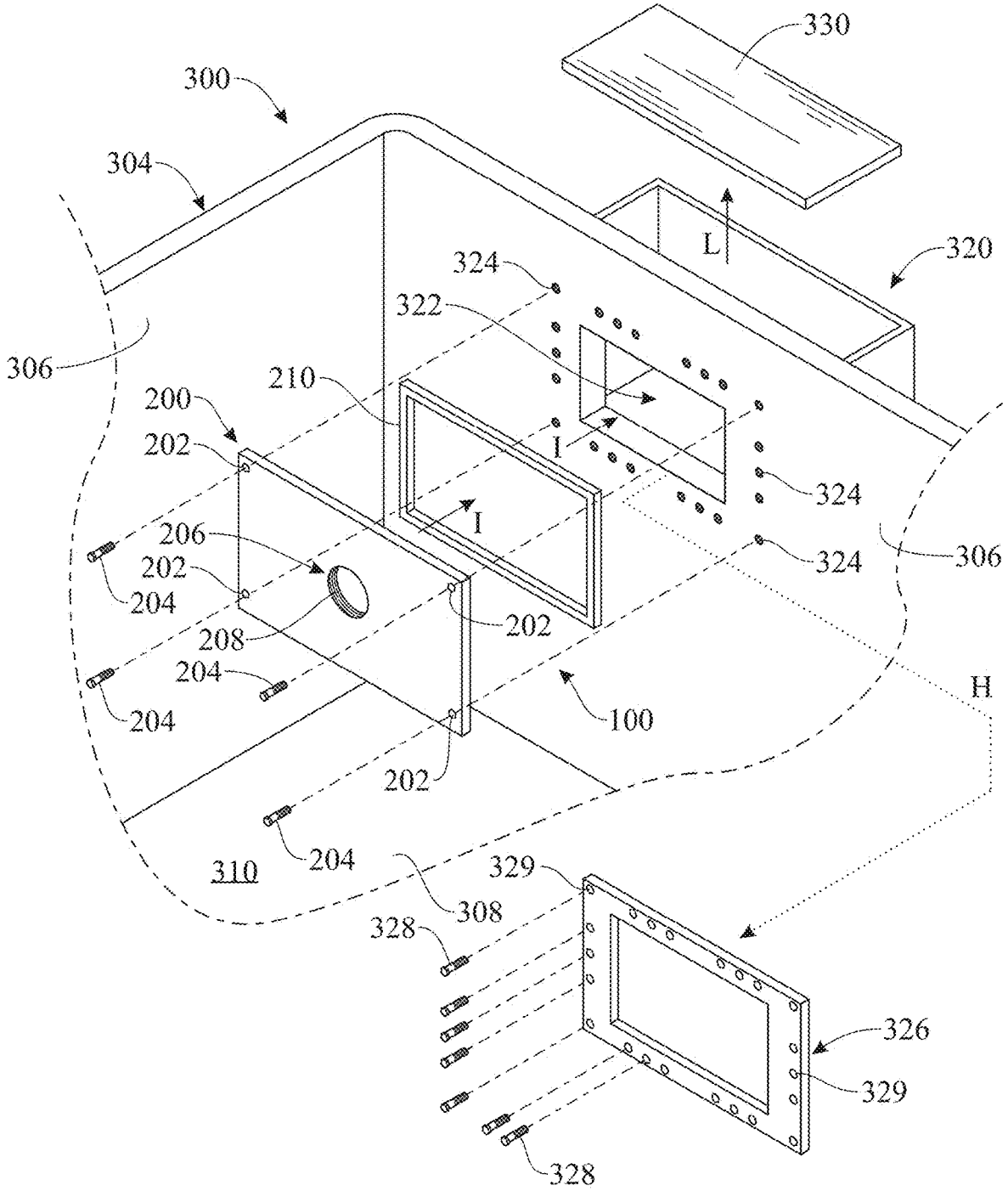
FIG. 9 presents a top isometric view of an existing skimmer frame being disconnected from a skimmer opening in the pool sidewall, and a skimmer plate being instead connected to the skimmer opening to provide a threaded opening for the cover hose and the air supply hose of the pool cover system, in accordance with a second illustrative method of operation of the pool cover system.

With reference now to FIG. 9, in some embodiments, the pool cover system 100 may include a skimmer plate 200, configured to be disconnectably mountable to a skimmer opening 322 provided on the inside of a sidewall 306 of the pool 300. For instance and without limitation, the skimmer plate 200 may be connectable to a plurality of skimmer fastener openings 324 formed in the sidewall 306 around the skimmer opening 322, once an existing skimmer frame 326 of the pool 300 has been removed from the skimmer opening 322 to reveal the skimmer fastener openings 324. It should be noted that, in normal usage conditions of the pool 300, the skimmer frame 326 may be attached to the sidewall 306 on the inside of the pool 300 by securing respective fasteners 328 through a respective plurality of fastener openings 329 formed in the skimmer frame 326 and threading the fasteners 328 into the plurality of skimmer fastener openings 324.

Figure 10:
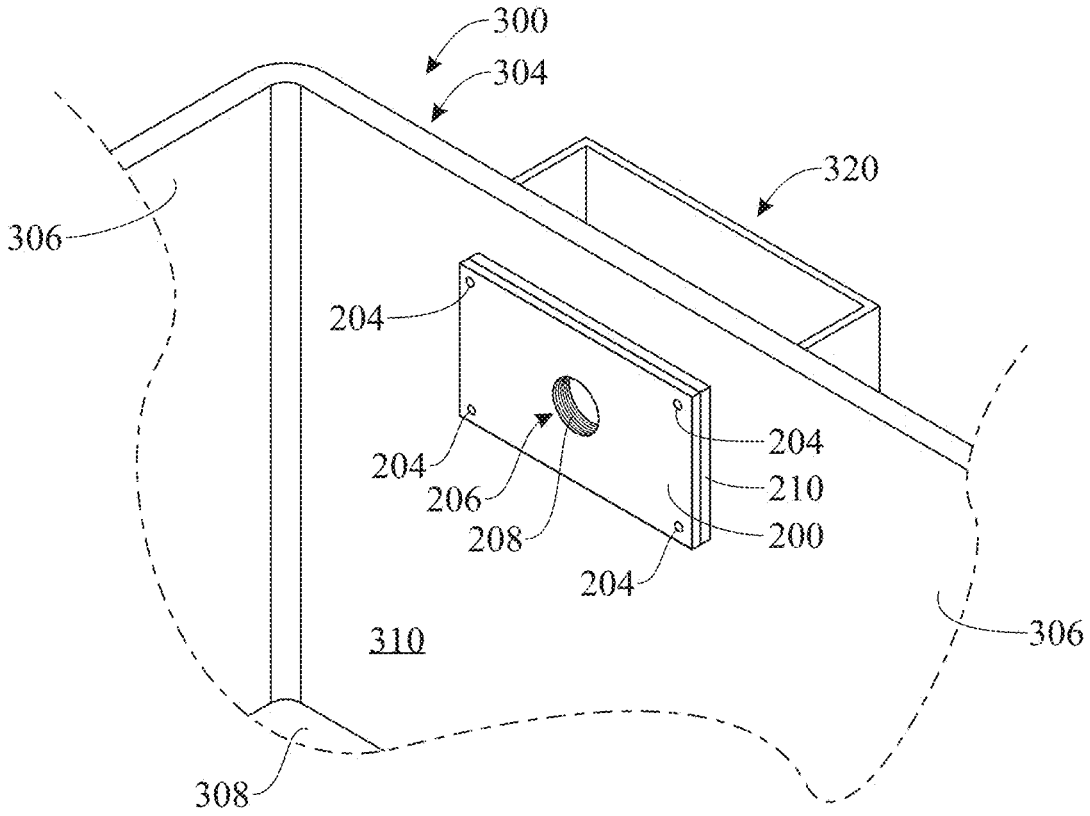
FIG. 10 presents a top isometric view, similar to FIG. 9, showing the skimmer plate mounted to the skimmer opening at the sidewall of the pool, in alignment with the pool skimmer.
Figure 11:
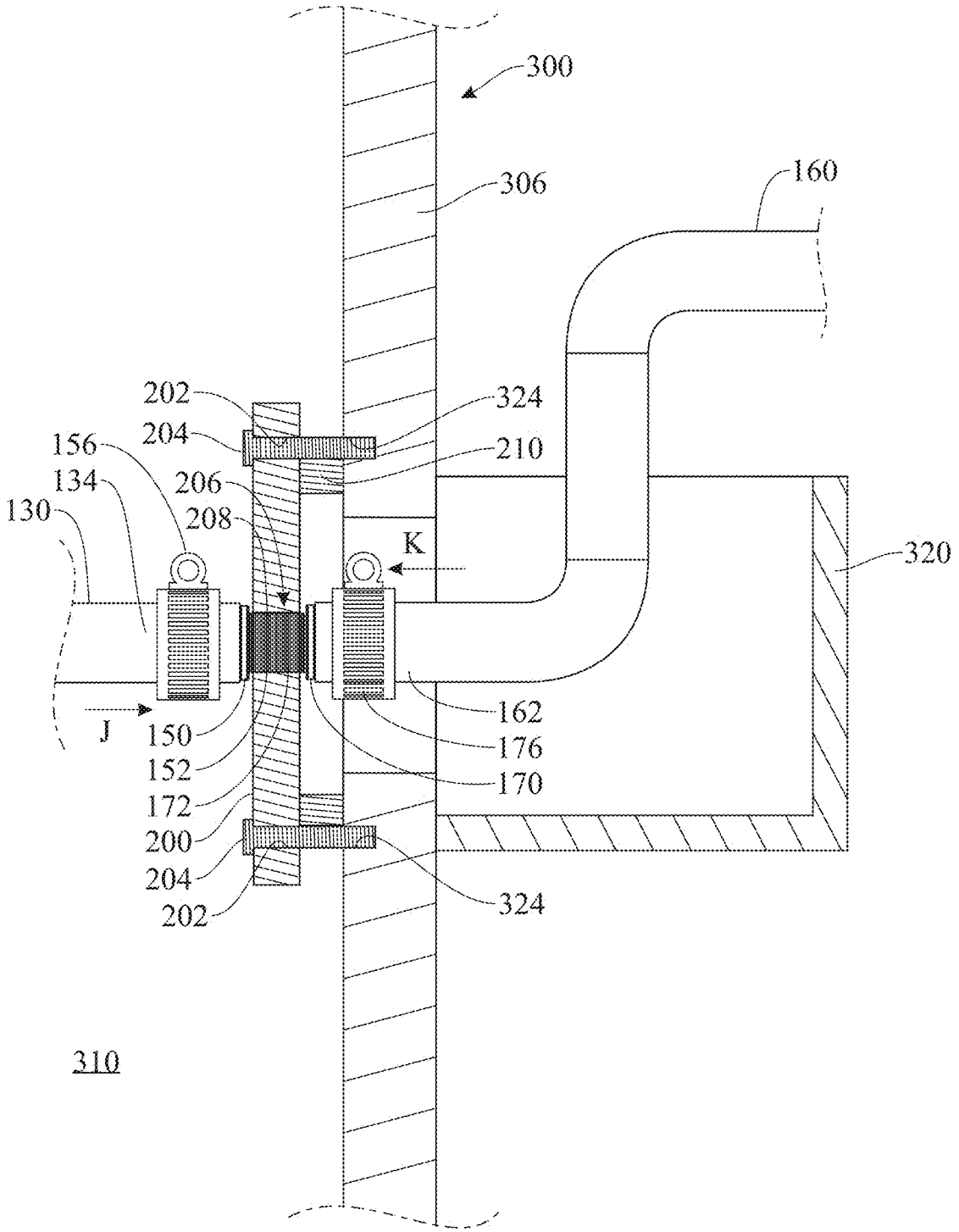
FIG. 11 presents an enlarged, cross-sectional side elevation view of the skimmer plate, sidewall, and skimmer of FIG. 10, shown assembled, the view further depicting the cover hose and the air supply hose connected to the threaded opening of the skimmer plate.

The skimmer plate 200 of the present invention may include one or more, and preferably a plurality of (e.g., four) fastener openings 202. One or more, and preferably a plurality of (e.g., four) corresponding fasteners 204 may be insertable through the fastener openings 202 and threaded into the skimmer fastener openings 324 to secure the skimmer plate 200 to the sidewall 306 of the pool 300. A threaded opening 206 may be formed in the skimmer plate 200, the threaded opening 206 provided with a thread 208. In some embodiments, such as the present embodiment, the pool cover system 100 may further include one or more elastically sealing members or gaskets, such as a rectangular sealing gasket 210. As shown in FIGS. 10 and 11, the sealing gasket 210 may be mounted between the skimmer plate 200 and the sidewall 306 of the pool 300 to provide an airtight sealing therebetween.

The threaded opening 206 of the skimmer plate 200 may be configured to connect to the second end 134 of the cover hose 130, similarly or the same as was heretofore described with reference to the threaded opening 314 of the pool return 340 (FIGS. 5 and 6). For instance and without limitation, the thread 208 of the threaded opening 206 may be configured to thread to the thread 152 of the second hose fitting 150, i.e. the thread 208 of the threaded opening 206 of the skimmer plate 200 may be shaped and sized the same as the thread 316 of the threaded opening 314 of the pool return 340, so that the second hose fitting 150 may be selectively mountable to either thread 208, 316 in different installations or methods of operation of the pool cover system 100 as will be hereinafter described.

Illustrative methods of installation and operation of the pool cover system 100 are now described, which are generally applicable to above-ground pools and, in some cases, both above-ground and in-ground pools.

In a first method of installation and operation of the pool cover system 100, and with reference initially to FIG. 5, the pool cover system 100 is installed using an existing pool return feature as an access point for supplying air to the inflatable cover assembly 110 and thereby inflating the cover assembly 110. More specifically, the access point is provided by an existing threaded opening 314 formed in the sidewall 306 of the pool 300 and associated with a pool return 340. This first illustrative method of installation and operation is generally applicable to above-ground pools, in which pool returns 340 may be arranged above the ground 360 (FIGS. 1 and 5).

Initially, and with reference to FIGS. 2 and 5, the deflated cover assembly 110 may be deployed over the top opening 302 of the pool 300, such as in a folded, rolled or otherwise partially deployed configuration in which part of the opening 302 remains open, allowing access to the pool cavity 210. Outer peripheral edges of the cover assembly 110 may be secured to the pool 300 such as using mechanisms known in the art, which may include, without limitation, ropes, bands, straps, or weights (e.g., water bags or sandbags). An operator may then access the pool cavity 310 and deploy the cover hose 130 within the pool cavity 310, as shown in FIG. 5. The operator may connect the first end 132 of the cover hose 130 to the air inlet 114 of the cover assembly 110. For instance, in the depicted embodiment, as shown in FIGS. 3 and 6 and heretofore described, the first hose fitting 140 may be threaded to the threaded fitting 120, and the first end 132 of the cover hose 130 may be sleeved over the first hose fitting 140 and secured thereto by the clamp 146.

Figure 4:
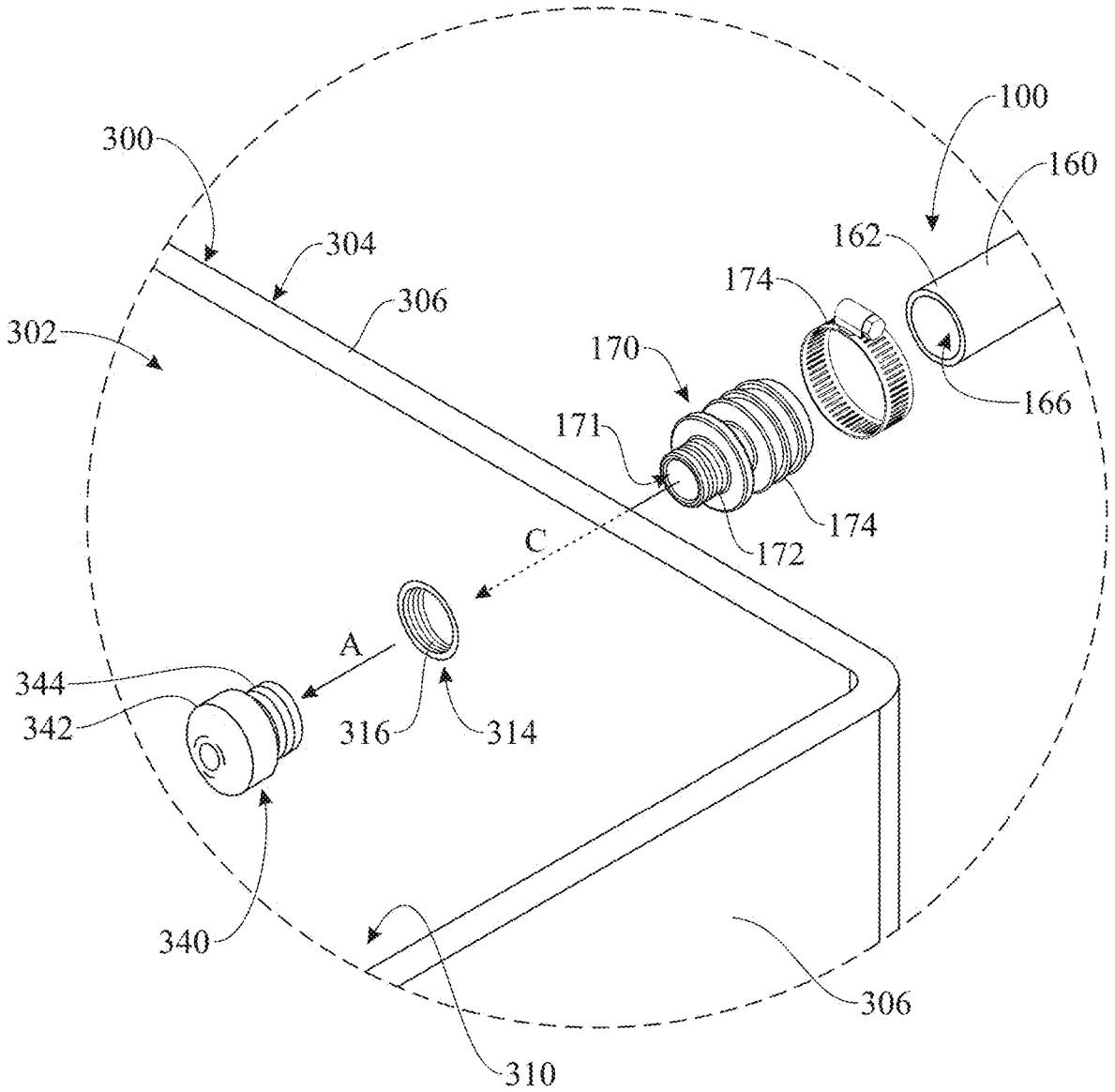
FIG. 4 presents a top isometric view of an existing pool return being disconnected from a threaded opening of a sidewall of the pool on an inner side of the sidewall, and an air supply hose, a second hose fitting and a clamp shown exploded and adjacent to an outer side of the sidewall, in accordance with a first illustrative method of operation of the pool cover system.

With reference to FIG. 4, the same operator, who is standing in the pool cavity 310, may disconnect the pool return 340 from the sidewall 306, as indicated by arrow A, at an inner side of the sidewall 306 facing the pool cavity 310. In the present embodiment, this is achieved by unthreading a thread 344 of the pool return 340 from the thread 316 of the existing threaded opening 314 in the sidewall 306. In turn, a corresponding return hose 358 (FIG. 1) of the pool's existing water recirculation system 318 may be disconnected from the threaded opening 314 at an outer side of the sidewall 306 by unthreading the return hose 358 from the threaded opening 314. Removal of the pool return 340 from the sidewall 306 causes the associated pool return threaded opening 314 to become exposed both on the inner side (FIGS. 4 and 5) and the outer side (FIG. 5) of the sidewall 306.

Next, as shown in FIG. 5, the operator may proceed to connect the second end 134 of the cover hose 130 to the threaded opening 314 on the inner side of the sidewall 306, as indicated by arrow B. More specifically, in the depicted embodiment, the second hose fitting 150 may be threaded to the threaded opening 314, and the second end 134 of the cover hose 130 may be sleeved over the second hose fitting 150 and secured thereto by the clamp 156, as shown in FIG. 6 and heretofore described. The operator may then step outside of the pool 300, and with reference to FIGS. 4-6, may connect the first end 162 of the air supply hose 160 to the threaded opening 314 on the outer side of the sidewall 306, as indicated by arrow C (FIG. 5). More specifically, in the depicted embodiment, the third hose fitting 170 may be threaded to the threaded opening 314 on the outer side of the sidewall 306, and the first end 162 of the air supply hose 160 may be sleeved over the third hose fitting 170 and secured thereto by the clamp 176, as shown in FIG. 6 and heretofore described. In turn, the second end 164 of the air supply hose 160 may be connected to pressurized air source 180, as heretofore described. At this point, the pool cover system 100 of the present disclosure provides fluid communication between the second end 164 of the air supply hose 160 and the air inlet 114 of the cover assembly 110, and therefore from the pressurized air source 180 to the interior space 112 of the cover assembly 110.

The operator may now unfold or otherwise deploy the cover assembly 110 to fully cover the top opening 302 of the pool 300, as indicated by arrow D, and finish securing the cover assembly 110 to the pool 300 with fasteners, weights, etc. Alternatively, the cover assembly 110 may be deployed and secured to the pool 300 prior to this time, once the cover hose 130 has been connected to the air inlet 114 of the cover assembly 110.

With the deflated cover assembly 110 fully deployed over the top opening 302 of the pool 300 and secured in place, and the hoses 130, 160 interconnecting the pressurized air source 180 to the cover assembly 110, the operator may proceed to activate the pressurized air source 180 to inject compressed air into the second end 164 of the air supply hose 160. As a result, as indicated in FIG. 6 by arrows E, compressed or pressurized air flows through the air supply hose 160, via the pool return threaded opening 314, further through the cover hose 130 inside the pool cavity 310, and finally into the interior space 112 of the cover assembly 110 through the air inlet 114. Air flowing into the interior space 112 presses against the panels 116, 118 of the cover assembly 110 causing the cover assembly 110 to inflate, as shown in FIG. 6. In preferred embodiments, such as the present embodiment, the inflated cover assembly 110 may have a convex top side 116*a*, at an outer top side or surface of the top panel 116. This convex configuration helps prevent water and debris from accumulating on top of the cover, i.e., on the top panel 116, as gravity may force water and debris to slide along the top side 116*a* of the top panel 116 towards the outer peripheral edge of the top panel 116 and to flow or slide off the top panel 116.

Turning to FIG. 7, once the cover assembly 110 has been inflated, the operator may proceed to disconnect the air supply hose 160 and third hose fitting 170 from the threaded opening 314 on the outer side of the sidewall 306, as indicated by arrow F and heretofore described, to expose the threaded opening 314. The operator may then airtightly seal the threaded opening 314 by threading the cap 190 to the threaded opening 314, as indicated by arrow G and heretofore described. The pool cover system 100 is now airtightly capped, inflated, and positioned covering the top opening 302 to protect the pool water and pool cavity 310 when not in use. Should the cover assembly 110 slightly deflate over time for any reason, the operator, homeowner, or other person may disconnect the cap 190 from the threaded opening 314 at the outer side of the pool 300 and reconnect the third hose fitting 170, air supply hose 160, and pressurized air source 180, and once more operate the pressurized air source 180 to re-inflate the cover assembly 110. Once re-inflated, the pool cover system 100 may again be airtightly sealed by once more reconnecting the cap 190 to the threaded opening 314 on the outer side of the pool 300 as heretofore described. In this way, the pool cover system 100 of the present disclosure may be easily and rapidly installed and maintained in operative condition via an access point readily and conveniently accessible at the outer side of the pool 300. It should be noted that uninstalling the pool cover system 100 may be easily and rapidly carried out by following a generally inverse procedure. Installation and removal of the pool cover system 100 may be advantageously carried out by a single person, without requiring the help of others or significant technical knowledge, skills, or strength.

In a second illustrative method of installation and operation of the pool cover system 100, the pool cover system 100 is instead installed using the pool skimmer 320, and more specifically, the skimmer opening 322, as an access point for supplying air to the inflatable cover assembly 110 and thereby inflating the cover assembly 110. This second illustrative method of installation and operation is generally applicable to both above-ground and in-ground pools.

Initially, the cover assembly 110 may be deployed over the top opening 302 and the first end 132 of the cover hose 130 connected to the cover assembly 110 following the same steps as in the first illustrative method of installation. Next, and with reference to FIG. 9, the operator may disconnect the fasteners 328 of the existing skimmer 320 on the inner side of the sidewall 306 of the pool 300, and remove the skimmer frame 326 from the skimmer opening 322 at the inner side of the sidewall 306 as indicated by arrow H. As a result, the skimmer fastener openings 324 arranged adjacent to the skimmer opening 322 are exposed.

Next, as indicated in FIG. 9 by arrows I, the operator may mount the skimmer plate 200 over the skimmer opening 322, with the sealing gasket 210 sandwiched between and sealingly contacting the skimmer plate 200 and the inner side of the sidewall 306. As shown in FIGS. 10 and 11, the operator may then secure the skimmer plate 200 and sealing gasket 210 in place by inserting the fasteners 204 through the respective fastener openings 202 in the skimmer plate 200 and threading the fasteners 204 into the respective skimmer openings 322 in the sidewall 306. Once the skimmer plate 200 has been attached to the sidewall 306 at the skimmer opening 322, as shown in FIGS. 10 and 11, the skimmer plate 200 covers the skimmer opening 322 with the exception of the threaded opening 206 of the skimmer plate 200. I.e., the skimmer plate 200 serves as an 'adapter' which 'converts' or 'adapts' skimmer opening 322 into threaded opening 206.

Once the threaded opening 206 has been produced at the skimmer opening 322, as shown in FIG. 11, the operator may connect the second end 134 of the cover hose 130 and the first end 162 of the air supply hose 160 to the threaded opening 322 at the inner side and the outer side of the skimmer plate 200, as indicated by arrows J and K, respectively. In some embodiments, prior to connecting the air supply hose 160, the operator may remove a skimmer top cover 330 from the skimmer 320, as indicated in FIG. 9 by arrow L, to allow the air supply hose 160 to be introduced inside the skimmer 320 and advanced towards the skimmer opening 322.

By means of the above connections, the interior space 112 of the deflated cover assembly 110 is now in fluid communication with the pressurized air source 180 via the cover hose 130, the "adapted" skimmer opening 322, and the air supply hose 160. With the deflated cover assembly 110 fully deployed over the top opening 302 of the pool 300 and secured in place, and the pool cover system 100 connected, the operator may proceed to activate the pressurized air source 180, causing the cover assembly 110 to inflate similarly as was heretofore described with reference to the first illustrative method of operation.

Once the cover assembly 110 has been inflated, the operator may proceed to disconnect the air supply hose 160 and third hose fitting 170 from the threaded opening 206 on the outer side of the skimmer plate 200 to expose the threaded opening 206, similarly to as was heretofore described with reference to the threaded opening 314 (arrow F in FIG. 7). The operator may then airtightly seal the threaded opening 206 by threading the cap 190 to threaded opening 206 as heretofore described with respect to the threaded opening 314 (arrow G in FIG. 7). The pool cover system 100 is now airtightly capped, inflated, and positioned covering the top opening 302 to protect the pool water and pool cavity 310 when not in use. As with the first illustrative method of operation, the convex shape of the inflated cover assembly 110 prevents water and debris from accumulating on top of the cover. Additionally, in installations in which the cover assembly 110 is applied to an in-ground pool (below ground 360'), the dome shape of the inflated cover assembly 110 may help prevent water bags or other movable securing elements from falling into the cover.

Should the cover assembly 110 slightly deflate over time for any given reason, the operator, homeowner, or other person may disconnect the cap 190 from the threaded opening 206, reconnect the third hose fitting 170, air supply hose 160, and pressurized air source 180, and once more operate the pressurized air source 180 to re-inflate the cover assembly 110. Once re-inflated, the pool cover system 100 may again be airtightly sealed by once more reconnecting the cap 190 to the threaded opening 206. In this way, the pool cover system 100 of the present disclosure may be easily and rapidly installed and maintained in operative condition via a readily and conveniently accessible access point (existing pool skimmer opening 322). It should be noted that uninstalling the pool cover system 100 may be easily and rapidly carried out by following a generally inverse procedure. As with the first illustrative method of operation, installation and removal of the pool cover system 100 through the pool skimmer may be advantageously carried out by a single person, without requiring the help of others or significant technical knowledge, skills, or strength.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A pool cover system, configured to cover a top opening of a pool when the pool is not in use, the pool comprising a pool cavity accessible through the top opening, the pool cover system comprising:

a cover assembly, inflatable from a deflated state to an inflated state through an air inlet of the cover assembly, the air inlet in fluid communication with an interior space of the cover assembly;

a cover hose, connectable between the air inlet of the cover assembly and an access point opening at a sidewall of the pool, from an inner side of the access point opening facing the pool cavity; and an air supply hose, connectable between a pressurized air source arranged outside the pool and the access point opening at the sidewall of the pool, from an outer side of the access point opening opposite the inner side; wherein the pool cover system is configured to adopt:

an inflation configuration in which the cover assembly is deployed over and fully covers the top opening of the pool, with the air inlet of the cover assembly accessible from the pool cavity, and the cover hose is arranged within the pool cavity and is connected to the air inlet of the cover assembly and to the access point opening from the inner side of the access point opening, and further in which the air supply hose is arranged outside the pool and is connected to the access point opening from the outer side of the access point opening and to a pressurized air source, and further in which fluid communication is established from the pressurized air source to the interior space of the cover assembly through the air supply hose and the cover hose, and an inflated configuration reachable from the inflation configuration by operating the pressurized air source to inject compressed air into the air supply hose and thereby inflating the cover assembly to the inflated state.

2. The pool cover system of claim 1, wherein the cover assembly comprises a bottom panel and a top panel arranged above the bottom panel, the interior space defined by and between the top and bottom panels, wherein the air inlet is arranged at the bottom panel, and further wherein an outer, top side of the top panel provides the outer, top side of the cover assembly.

3. The pool cover system of claim 1, wherein, in the inflated configuration of the pool cover system, an outer, top side of the cover assembly opposite the pool cavity is shaped to direct water and debris falling thereon towards an outer peripheral edge of the cover assembly by gravity.

4. The pool cover system of claim 3, wherein the air inlet is arranged at a bottom panel of the cover assembly, and further wherein, in the inflated configuration of the pool cover system, the bottom panel faces the pool cavity and is generally flat.

5. The pool cover system of claim 3, wherein, in the inflated configuration of the pool cover system, the outer, top side of the cover assembly is entirely convex and dome-shaped.

6. The pool cover system of claim 5, wherein the cover assembly comprises a bottom panel and a top panel arranged above the bottom panel, the interior space defined by and between the top and bottom panels, wherein the air inlet is arranged at the bottom panel, and further wherein an outer, top side of the top panel provides the outer, top side of the cover assembly, and further wherein, in the inflated configuration of the pool cover system, the top panel is dome-shaped.

7. The pool cover system of claim 1, wherein, in both the inflation configuration and the inflated configuration of the pool cover system, the cover hose is arranged within the pool cavity in its entirety.

8. The pool cover system of claim 1, wherein the cover hose is disconnectably connectable to the air inlet of the cover assembly.

9. The pool cover system of claim 8, further comprising a hose fitting configured to disconnectably thread the cover hose to the air inlet of the cover assembly.

10. The pool cover system of claim 1, wherein the cover hose is disconnectably connectable to the access point opening.

11. The pool cover system of claim 10, further comprising a hose fitting configured to disconnectably thread the cover hose to the access point opening.

12. The pool cover system of claim 1, wherein the air supply hose is disconnectably connectable to the pressurized air source.

13. The pool cover system of claim 1, wherein the air supply hose is disconnectably connectable to the access point opening.

14. The pool cover system of claim 13, further comprising a hose fitting configured to disconnectably thread the air supply hose to the access point opening.

15. The pool cover system of claim 13, further comprising a cap, wherein the cap is disconnectably connectable to the access point opening at the sidewall of the pool, from the outer side of the access point opening and in lieu of the air supply hose, to sealingly close the access point opening, and further wherein the pool cover system is further configured to adopt a sealed configuration, the sealed configuration reachable from the inflated configuration by disconnecting the air supply hose from the access point opening and instead connecting the cap to the access point opening with the cover assembly in the inflated state, the cap sealingly closing the access point opening and preventing air in the inflated cover from escaping through the access point opening.

16. The pool cover system of claim 1, wherein the access point opening is a pool return opening.

17. The pool cover system of claim 1, further comprising a skimmer plate sealingly attachable to a skimmer opening at the sidewall of the pool, the skimmer plate comprising the access point opening, wherein, in the inflation configuration of the pool cover system, the skimmer plate is sealingly secured to the skimmer opening and the access point opening is positioned at the skimmer opening.

18. The pool cover system of claim 17, wherein the skimmer plate comprises one or more fastener openings configured to align with respective one or more skimmer fastener openings of the pool for the insertion of respective one or more fasteners therethrough to secure the skimmer plate over the skimmer opening.

19. A pool cover system, configured to cover a top opening of a pool when the pool is not in use, the pool comprising a pool cavity accessible through the top opening, the pool cover system comprising:

a cover assembly, inflatable from a deflated state to an inflated state through an air inlet of the cover assembly, the air inlet in fluid communication with an interior space of the cover assembly;

a cover hose, connectable between the air inlet of the cover assembly and an access point opening at a sidewall of the pool, from an inner side of the access point opening facing the pool cavity; and an air supply hose, connectable between a pressurized air source arranged outside the pool and the access point opening at the sidewall of the pool, from an outer side of the access point opening opposite the inner side; wherein the pool cover system is configured to adopt:

an inflation configuration in which the cover assembly is deployed over and fully covers the top opening of the pool, with the air inlet of the cover assembly accessible from the pool cavity, and the cover hose is arranged entirely within the pool cavity and is connected to the air inlet of the cover assembly and to the access point opening from the inner side of the access point opening, and further in which the air supply hose is arranged outside the pool and is connected to the access point opening from the outer side of the access point opening and to a pressurized air source, and further in which fluid communication is established from the pressurized air source to the interior space of the cover assembly through the air supply hose and the cover hose, and an inflated configuration reachable from the inflation configuration by operating the pressurized air source to inject compressed air into the air supply hose and thereby inflating the cover assembly to the inflated state, wherein, in said inflated configuration, an outer, top side of the cover assembly opposite the pool cavity is shaped to direct water and debris falling thereon towards an outer peripheral edge of the cover assembly by gravity.

20. A pool cover system, configured to cover a top opening of a pool when the pool is not in use, the pool comprising a pool cavity accessible through the top opening, the pool cover system comprising:

a cover assembly, inflatable from a deflated state to an inflated state through an air inlet of the cover assembly, the air inlet in fluid communication with an interior space of the cover assembly;

a cover hose, connectable between the air inlet of the cover assembly and an access point opening at a sidewall of the pool, from an inner side of the access point opening facing the pool cavity; and an air supply hose, connectable between a pressurized air source arranged outside the pool and the access point opening at the sidewall of the pool, from an outer side of the access point opening opposite the inner side; and a cap, disconnectably connectable to the access point opening at the sidewall of the pool, from the outer side of the access point opening and in lieu of the air supply hose, to sealingly close the access point opening; wherein the pool cover system is configured to adopt:

an inflation configuration in which the cover assembly is deployed over and fully covers the top opening of the pool, with the air inlet of the cover assembly accessible from the pool cavity, and the cover hose is arranged entirely within the pool cavity and is connected to the air inlet of the cover assembly and to the access point opening from the inner side of the access point opening, and further in which the air supply hose is arranged outside the pool and is connected to the access point opening from the outer side of the access point opening and to a pressurized air source, and further in which fluid communication is established from the pressurized air source to the interior space of the cover assembly through the air supply hose and the cover hose, an inflated configuration reachable from the inflation configuration by operating the pressurized air source to inject compressed air into the air supply hose and thereby inflating the cover assembly to the inflated state, wherein, in said inflated configuration, an outer, top side of the cover assembly opposite the pool cavity is shaped to direct water and debris falling thereon towards an outer peripheral edge of the cover assembly by gravity, and a sealed configuration reachable from the inflated configuration by disconnecting the air supply hose from the access point opening and instead connecting the cap to the access point opening with the cover assembly in the inflated state, the cap sealingly closing the access point opening and preventing air in the inflated cover from escaping through the access point opening.

* * * * *